United States Patent [19]

Patel

[11] 4,233,716

[45] Nov. 18, 1980

[54] PHOTOELECTRIC HEDDLE DETECTION DEVICE

[75] Inventor: Dhiru B. Patel, Rockford, Ill.

[73] Assignee: Barber-Colman Company, Rockford, Ill.

[21] Appl. No.: 11,299

[22] Filed: Feb. 12, 1979

[51] Int. Cl.[3] ..... D03J 1/14

[52] U.S. Cl. ..... 28/187; 28/207

[58] Field of Search ..... 28/187, 203, 204, 206, 28/207

[56] References Cited

U.S. PATENT DOCUMENTS

| | | | |
|---|---|---|---|
| 2,233,483 | 3/1941 | Metcalf | 28/187 X |
| 2,683,300 | 7/1954 | Vidal | 28/187 |
| 3,072,999 | 1/1963 | Cook et al. | 28/204 |
| 3,869,770 | 3/1975 | McCullough | 28/187 |
| 4,038,729 | 8/1977 | Townsend | 28/206 |

FOREIGN PATENT DOCUMENTS

| | | | |
|---|---|---|---|
| 1352332 | 5/1974 | United Kingdom | 28/207 |

*Primary Examiner*—Robert Mackey

*Attorney, Agent, or Firm*—Robert M. Hammes, Jr.; A. Richard Koch

[57] ABSTRACT

Apparatus for detecting absence or misalignment of heddles at the drawing-in position on a warp drawing machine by photoelectric means. The detection of such a condition is employed to stop the operation of the warp drawing machine until the condition is corrected.

10 Claims, 7 Drawing Figures

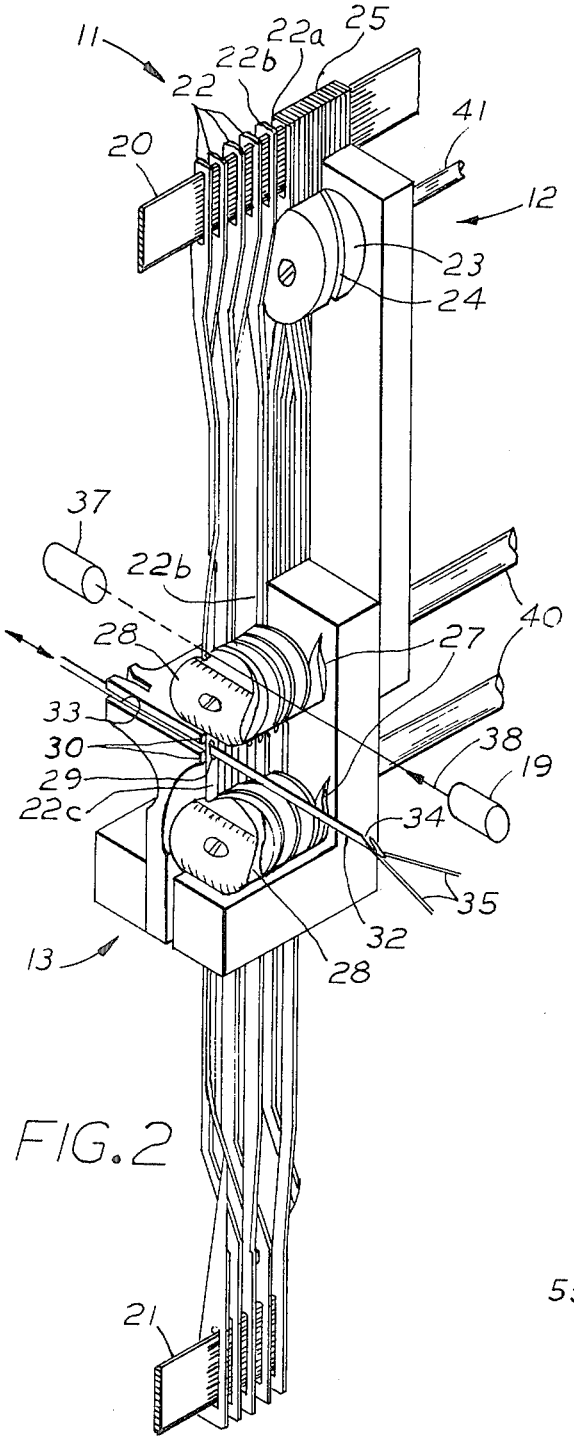
FIG. 2
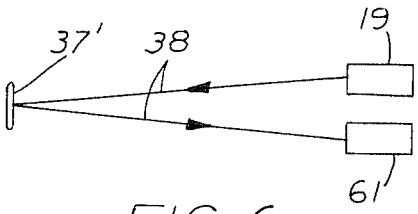
FIG. 6
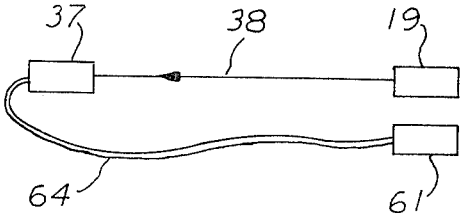
FIG. 7
FIG. 5
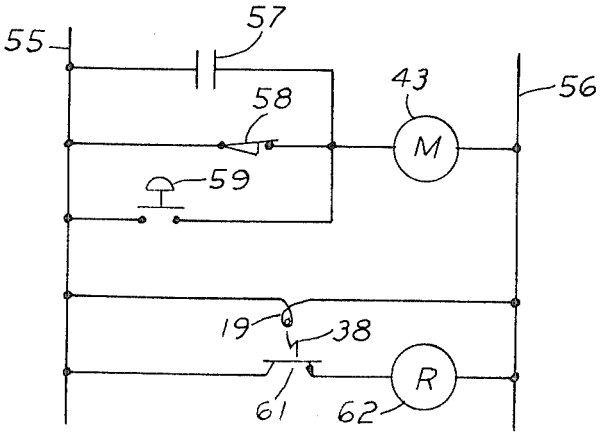

PHOTOELECTRIC HEDDLE DETECTION DEVICE

BACKGROUND OF THE INVENTION

This invention concerns the preparation of warp strands for weaving and more specifically with drawing-in warp strands.

In preparation for weaving, warp strands are drawn through eyes in respective heddles mounted on a heddle frame. U.S. Pat. No. 4,038,729, issued on Aug. 2, 1977 to Franklin L. Townsend, describes an apparatus, and its operation, for accomplishing the selection and positioning of a heddle such that its eye can receive a next successive warp strand from a warp beam during the drawing-in operation. When the heddle is thus positioned according to Townsend's teachings, or by any other means, a needle passing through the eye draws a warp strand through the eye. If, by any chance, a heddle is not present when the needle attempts to insert the warp strand, there would be a resulting error in the warp. Such an error can be corrected by inserting a replacement heddle in proper position on the frame and drawing-in the omitted warp strand. Replacement heddles are heavier than other heddles and for that reason are undesirable on a high speed loom. If a heddle is present, but not properly positioned, the warp strand will not be drawn through the eye. Since the heddle is present, it is only necessary to manually draw the warp strand through the eye. As a result of either of these deficiencies in positioning a heddle, the drawing-in operation must be stopped and someone must take the time necessary to correct the faults produced thereby. Production is therefore impaired and costs are increased.

In the past, someone had to be continuously present in order to immediately detect and correct the fault caused by absence of misalignment of a heddle. This was expensive. As an alternative, the fault would not be detected and corrected until later. The task of correcting the fault was then complicated. Immediate detection and correction of such faults without the continuous presence of someone to accomplish such results was obviously desirable.

SUMMARY OF THE INVENTION

According to this invention, a narrow beam of light is directed across the warp drawing machine in a position to be interrupted by a properly positioned heddle on any of the warp frames. A photo detector located on the opposite side of the machine from the light source, receives the light in the absence, or the improper positioning, of a heddle, producing a signal stopping operation of the machine until the condition is corrected.

Light travels so fast that detection is substantially instantaneous. Light has substantially no weight, so it does not increase the load on the warp drawing machine. The capital and operating costs of the detector are substantially negligible.

BRIEF DESCRIPTION OF THE DRAWINGS

FIG. 2 is an enlarged perspective view of a portion of FIG. 1.

FIG. 5 is a circuit drawing of the pertinent portions of the heddle detector control.

FIGS. 6 and 7 show alternative paths for the light beam.

DESCRIPTION OF THE PREFERRED EMBODIMENT

Figure 1:
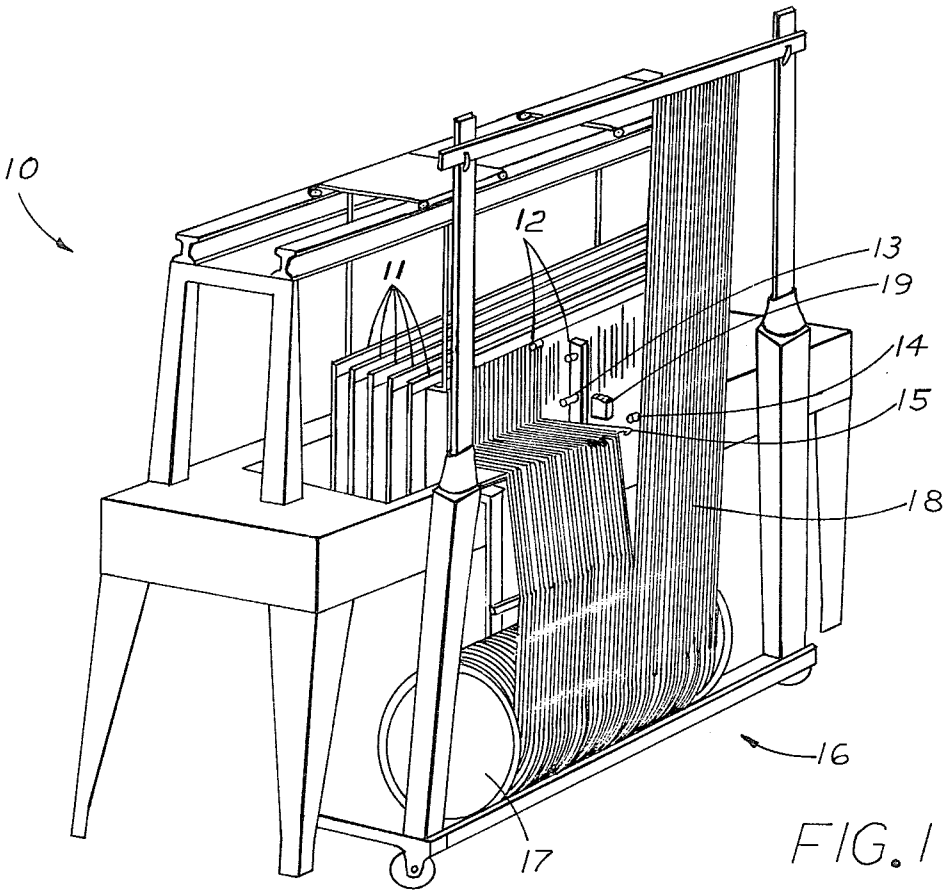
FIG. 1 is a perspective view of a warp drawing machine.

As seen in FIG. 1, a warp drawing machine 10 has a plurality of heddle frames 11 mounted side-by-side thereon lengthwise of the machine, a heddle selecting mechanism 12 and a heddle positioning mechanism 13 for each heddle frame, a warp strand separator 14, a drawing-in mechanism 15, and means (not shown) for synchronizing the operation of the various components. Also shown is a warp transport truck 16, with a warp beam 17 and warp sheet 18 thereon, as a separable but integral part of the warp drawing machine. Means for drawing the warp through drop wires and reeds, which may or may not be included in warp drawing machines are not shown, since they are not involved in the invention. What has been described is well-known in the prior art. The new feature is a light source 19 projecting a beam of light across the warp drawing machine to a similarly located light beam detector (see FIG. 2) on the other side of the heddle frames.

As shown in FIG. 2 a heddle frame 11 comprises upper and lower heddle bars 20, 21 on which a plurality of heddles 22 (shown as duplex heddles) are slidably supported. The heddle selecting mechanism 12 is shown as comprising a cylinder 23 having a helical groove 24 therein to engage and separate the end heddle 22*a* from a pack 25 of heddles upon counter-clockwise rotation of the heddle selecting mechanism and to advance the separated heddle along the heddle bars 20, 21 to position 22*b*. In position 22*b*, the separated heddle is engaged by counter-clockwise rotating advancing worms 27 and thus further advanced along heddle bars 20, 21 and into engagement with turning worms 28. The turning worms twist a portion 22*c* of the heddle surrounding an eye 29 into a position for receiving a warp strand such that the twisted portion lies in substantially the same plane as the heddle bars. The portion in this position is held on one side by fixed surfaces 30 engaging the heddle adjacent the eye and on the opposite side of the heddle by the turning worm. The eye is thus held in warp strand receiving position. While the eye occupies this warp strand receiving position, a needle 32, being a component of the drawing-in mechanism 15, is thrust forward, guided into and through the eye by a channel 33 aligned with the eye. A notch 34 in the free end of the needle engages a warp strand 35 separated from the warp sheet 18 by the warp strand separator 14. The needle is then retracted, drawing the engaged warp strand through the eye. Upon further rotation of the heddle positioning mechanism, the heddle is advanced further along the heddle bars 20, 21 and released from the heddle positioning mechanism. The apparatus in FIG. 2 and the operation thereof so far described is well-known in the art. This invention involves the addition of the light source 19 and a light beam receiver 37 on opposite sides of the warp frame 11. The light source is positioned to project a beam of light 38 to the light beam receiver along a path passing through the position occupied by any heddle, the eye of which occupies the warp strand receiving position, so that the beam is interrupted when any heddle is in such a position. The advancing and turning worms 27, 28 are rotated in unison and usually periodically by shafts 40. The cylinder 23 is rotated by shaft 41 in synchronism with shafts 40.

Figure 3:
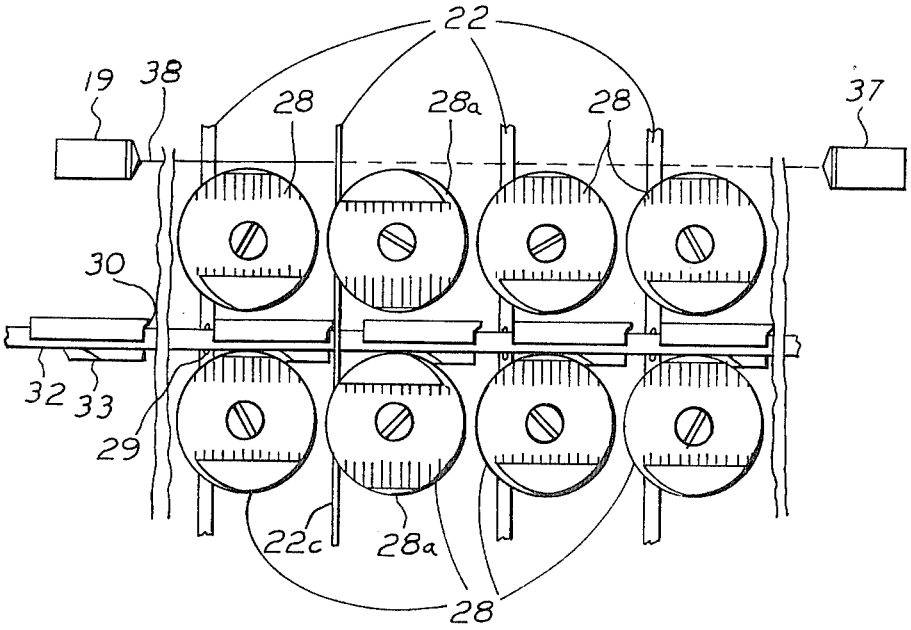
FIG. 3 is an enlarged partial elevation of a portion of FIG. 1 showing the positions of the turning worms on a warp drawing machine and the location of the beam of light.

Since the needle 32 passes through all of the heddle frames 11 and since any given warp strand 35 must be received in the eye 29 of only one heddle 22, it can be seen that only one heddle can be twisted into warp strand receiving position at any one time. FIG. 3 shows a plurality of heddles 22 with respective turning worms 28, surfaces 30 and channels 33. The turning worms occupy either of two angular positions 180° apart, with only one pair **28*a* of turning worms, acting on the same heddle 22*c*, being in the turned heddle position. Because heddle 22*c* is the only one twisted, it will be noted that the needle 32** passes only through the eye of this heddle and passes before the other heddles.

Figure 4:
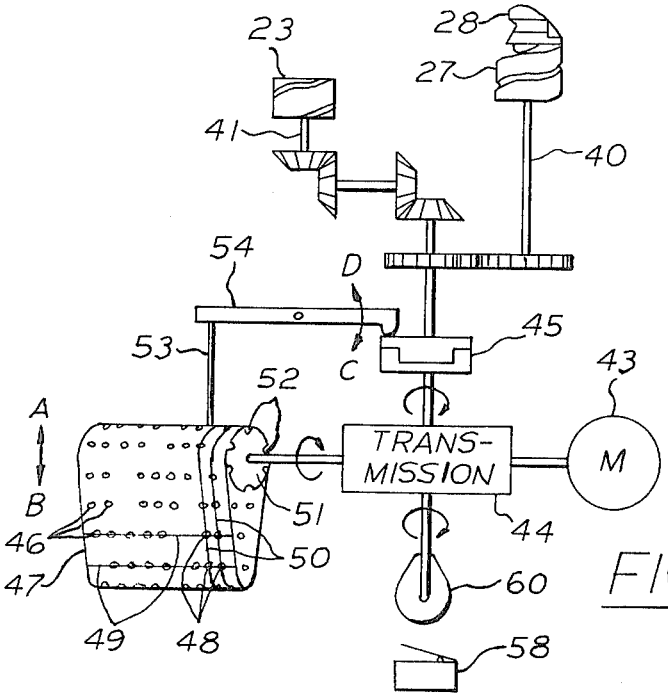
FIG. 4 is a schematic drawing demonstrating the mechanical operation of the warp drawing machine.

There may be as many as thirty-two heddle frames mounted on the warp drawing machine 10, so it can be seen that the only practical way in which only one heddle at a time is twisted is to rotate only one pair **28*a* of turning worms at a time, thereby twisting only one heddle 22*c* into the turned heddle position, while the others remain in heddle receiving position. Periodic rotation of successive pairs of turning worms is therefore indicated. FIG. 4 shows a machine drive motor 43 supplying the input to a transmission 44. The advancing and turning worms 27, 28 on any shaft 40, only one of which is shown, and the cylinder 23 on the respective one of shafts 41 are rotated by the transmission only when a respective clutch 45 is engaged. The clutch is engaged in response to the absence of holes 46 selectively punched through an endless pattern 47 at the intersections 48 of equally spaced axial rows 49 with spaced annular tracks 50. The pattern passes over a pattern spool 51 having equally spaced axial grooves 52 on its periphery, the spacing between grooves being the same as that between the rows. The pattern spool is intermittently rotated by the transmission 44 to advance one spacing between grooves, while the pattern is driven by the spool such that each row in passing over the spool is centered over one of the grooves. A plurality of plungers 53 lie in a plane extending radially from the pattern spool and through one of the grooves underlying a row when the spool is not being rotated. The plungers are also aligned with respective ones of the tracks. The pattern spool 51, when not rotating is reciprocated laterally A, B by the transmission first toward the plungers 53 and then away from them, such that plungers aligned with holes 46 enter the holes and the underlying groove 52 without being moved longitudinally, while plungers not aligned with holes do not penetrate the pattern 47 and are moved longitudinally by the reciprocation of the spool. A clutch 45 is engaged upon oscillatory movement C of a lever 54 in response to longitudinal movement A and is released upon oscillatory movement D in response to longitudinal movement B of the respective one of said plungers. The turning worm 28 must make a half revolution for each engagement of its clutch 45—from heddle receiving position into turned heddle position 28*a* and then from turned heddle position back to heddle receiving position. This requires two engagements of the clutch, so there must be two successive intersections 48 in the respective one of said tracks 50 without holes 46. Since only one heddle can be turned at any given time, there may be no more than two intersections 48 without holes in each row 49**.

As seen in FIG. 5, the machine drive motor 43 is coupled between power lines 55 56 through any of normally open relay contacts 57, a normally closed cam operated switch 58 or a normally open manually operated switch 59. The normally closed cam operated switch 58 is periodically opened by a cam 60 driven by motor 43 through transmission 44 (see FIG. 4) at a frequency equal to the intermittent rotary advance of the pattern spool 51 such that the switch 58 is opened in synchronism with the orientation of any turning worm 28 in the turned heddle position **28*a*. The light source 19 is continuously energized, producing the beam of light 38 directed toward the light beam receiver 37, which in this FIG. 5 is shown as a photoelectric device 61. When the beam of light 38 is detected by the photoelectric device, it produces a signal closing a circuit to relay coil 62, thereby opening relay contacts 57. The machine drive motor 43 is stopped if the cam operated switch 58 is simultaneously open. This stops the entire warp drawing operation and only occurs when no portion 22*c* of any heddle 22 is in the heddle turned position when any of the turning worms 28 is in turned heddle position 28*a*. The motor 43 remains idle until the faulty condition has been corrected or the switch 59** is manually closed.

FIG. 6 shows an alternative path for the light beam 38, the beam being reflected by light beam receiver 37' to a photoelectric device 61 located at any convenient location. As shown the photoelectric device is adjacent to the light source 19 so that the electrical circuits therefor are on one side of the warp drawing machine. The reflected light beam must not then be interrupted unless the direct light beam is simultaneously interrupted.

FIG. 7 shows an alternative light path wherein the light received by light beam receiver 37 is conducted to the photoelectric device 61 by a light conductor 64, such as a fiber optic cable.

While relays, switches and cams have been shown and described, it will be obvious to those skilled in the art that solid state or other equivalent devices could be substituted therefor. In like manner, other light sources could replace the incandescent lamp shown and a photoelectric tube could be substituted for the shown light sensitive transistor 61. The photoelectric device 61 could be a photocell which generates electricity when exposed to light, thereby making unnecessary the connection thereof between lines 55, 56. The described warp drawing machine is only exemplary, the heddle detector invention being applicable to other warp drawing machines as well. Equivalent circuitry will also become obvious.

I claim:

1. In a warp drawing machine having at least one heddle frame mounted thereon, each of said heddle frames having a pack of heddles slidably supported thereon, each of the heddles in said pack having a warp strand receiving eye therethrough, a heddle selecting mechanism for each of said heddle frames to separate an end one of said heddles from the pack on the frame, a heddle positioning mechanism for each of said heddle frames adapted to cooperate with a respective heddle selecting mechanism to engage and position the separated heddle such that the eye thereof occupies a predetermined warp strand receiving position, a drawing-in mechanism adapted to cooperate with said heddle position mechanisms for drawing successive ones of a plurality of warp strands through the eye of respective successively positioned ones of said heddles, and a heddle detecting device operatively associated with the heddle positioning mechanisms for detecting the absence of any heddle being in a warp strand receiving position, said heddle detecting device comprising a light source producing a beam of light, said source located to one side of said heddle frames and said heddle selecting and positioning mechanisms in a position to project said beam of light across the machine in a path interrupted by any of said positioned heddles, a light beam receiver located to the opposite side of said heddle frames and said heddle selecting and positioning mechanisms in a position to receive the beam of light when no heddle is in a warp strand receiving position, and a photoelectric device producing a signal in resonse to reception of the beam of light by said light beam receiver.

2. A heddle detecting device according to claim 1 wherein the path of said beam of light lies closely adjacent to each of said heddle positioning mechanisms.

3. A heddle detecting device according to claim 1 wherein the beam of light received by said light beam receiver is narrower than the width of any of said heddles where the heddles interrupt the beam of light.

4. A heddle detecting device according to claim 1 wherein said photoelectric device is located in said light beam receiver.

5. A heddle detecting device according to claim 1 wherein said light beam receiver conducts the beam of light to said photoelectric device.

6. A heddle detecting device according to claim 1 wherein said light beam receiver reflects the beam of light to said photoelectric device.

7. A heddle detecting device according to claim 6 wherein said reflected light beam follows a second path interrupted by any of said positioned heddles.

8. A heddle detecting device according to claim 1 wherein said photoelectric device generates said signal.

9. A heddle detecting device according to claim 1 wherein an electrical property of said photoelectric device is altered by the interruption of said beam of light to produce said signal in a control circuit.

10. A heddle detecting device according to claim 1 further comprising a control circuit operable to stop operation of the warp drawing machine in response to said signal indicating the absence of any positioned heddle at such time as any of said heddle positioning mechanisms is oriented to position any of said heddles such that the eye thereof occupies one of the predetermined warp strand receiving positions.

* * * * *